US005466181A

United States Patent [19]

Bennett et al.

[11] Patent Number: 5,466,181

[45] Date of Patent: Nov. 14, 1995

[54] DOLL HAVING CONDUCTIVE OUTER SKIN AREAS AND INTERNAL BATTERY SUPPLY

[75] Inventors: Linda K. Bennett, Marina Del Rey; Joseph Feldman, Los Angeles, both of Calif.

[73] Assignee: Mattel, Inc., El Segundo, Calif.

[21] Appl. No.: 251,156

[22] Filed: May 31, 1994

[51] Int. Cl.[6] ..... A63H 3/28; A63H 33/26

[52] U.S. Cl. ..... 446/297; 446/485

[58] Field of Search ..... 446/297, 302, 446/303, 484, 485, 438, 439, 471, 462, 139

[56] References Cited

U.S. PATENT DOCUMENTS

| | | | |
|---|---|---|---|
| 144,577 | 2/1907 | Borohardt | 446/484 X |
| 413,058 | 10/1889 | Hirsch . | |
| 2,310,037 | 2/1943 | Reno | 446/485 X |
| 3,949,517 | 4/1976 | Reiner et al. | 446/485 X |
| 4,072,314 | 2/1978 | Rosen et al. | 446/485 X |
| 4,109,413 | 8/1978 | Brown . | |
| 4,237,647 | 12/1980 | Shaw | 446/303 |
| 4,553,748 | 11/1985 | Allen et al. . | |
| 4,559,393 | 12/1985 | Holubka . | |
| 4,826,550 | 5/1989 | Shimizu et al. . | |
| 4,867,726 | 9/1989 | Fujimaki | 446/303 X |
| 4,878,873 | 11/1989 | Yamaguchi et al. | 446/485 X |
| 5,002,511 | 3/1991 | Maki . | |
| 5,049,107 | 9/1991 | De Nittis . | |
| 5,052,969 | 10/1991 | Smith | 446/485 X |
| 5,114,376 | 5/1992 | Copley et al. | 446/485 X |

FOREIGN PATENT DOCUMENTS

| | | | |
|---|---|---|---|
| 864004 | 4/1941 | France | 446/139 |
| 2238014 | 8/1972 | Germany . | |

*Primary Examiner*—Robert A. Hafer
*Assistant Examiner*—D. Neal Muir
*Attorney, Agent, or Firm*—Roy A. Ekstrand

[57] ABSTRACT

A doll includes a hollow torso within which a battery power source is supported. The doll further includes a pair of outer surface areas supporting coating or deposits of conductive material. Electrical connection is provided between the conductive outer surface areas and the internal battery power source. A plurality of electrical toy apparatus such as a music or sound producing device or a lighted mirror are provided with conductive pads and electrical connection thereto. In the anticipated play pattern, the doll contacts the electrical apparatus conductive pads using the conductive outer areas of the doll's outer surface to provide electrical connection between the internal battery power supply of the doll and the electrical toy apparatus. Thereafter and so long as the contact is maintained, the battery source within the doll powers the electrical apparatus to provide the desired effect.

7 Claims, 3 Drawing Sheets

107
105
101
97
103
90
91
99
98
111
96
102
106
109
92
93
114
113
115
112
108
104
95
94
110
132
130
129
133
131
123
122
120
128
127
121
124
126

DOLL HAVING CONDUCTIVE OUTER SKIN AREAS AND INTERNAL BATTERY SUPPLY

FIELD OF THE INVENTION

This invention relates generally to dolls and toy figures and particularly to those utilizing battery-powered apparatus.

BACKGROUND OF THE INVENTION

Electrically powered toys are well known in the art and have taken a virtually endless variety of forms and functions. For example, toy vehicles having internal electrically powered motor drive apparatus are well known in the art and available in virtually an endless array of shapes and sizes. Such toy vehicles have included remote control apparatus which responds to signals provided by a remote transmitter to control the operation of the toy vehicle. Sound producing and talking toys as well as music producing toys are also extremely well known and found in a variety of forms and configurations. Such toys have included battery-powered music and speech apparatus as well as toys directed toward producing sound effects such as animal sounds or the like. Another type of electrically powered toy involves the provision of dolls or toy figures which have articulated appendages and body components and which include battery-powered motor drive apparatus for moving articulated appendages and torso components. Such dolls and toy figures have been provided which perform activities such as skating, dancing, walking, crawling, crying, etc. and have become commonplace in the art. In addition, other electrically responsive toys have been provided such as lighted implements or the like.

For example, U.S. Pat. No. 4,109,413 issued to Brown sets forth a LEVITATION TOY AND METHOD OF OPERATION THEREOF in which electrostatically charged components of the same polarity comprising a charged tube or wand for launching into and maintaining levitation or flight of any selected similarly charged levitatable objects. In one embodiment shown, an elongated cylindrical rod is charged along with a levitatable football-shaped object to the same polarity of charge causing the football to levitate as the wand is placed beneath it. In other embodiments, two-dimensional objects are similarly charged and levitated.

U.S. Pat. No. 5,049,107 issued to DeNittis sets forth a SOUNDBOX DEVICE having a generally spherical container provided on its surface with graphic fields associated with respective contacts connected to a microprocessor within the container. The soundbox also includes a loud speaker and circuitry which, upon pressing one of the fields, generates a sound sequence representing the geographic depiction of that field.

U.S. Pat. No. 5,002,511 issued to Maki sets forth STUFFED TOYS WITH HEAT RESPONSIVE INFRA-RED RADIATION useful as ornaments, mascots or the like in which a filler is sealed into a bag-like body comprising a laminant wherein a pliable sheet having a far infrared radiation layer on one surface thereof is superposed to an inner side of a cover sheet with the far infrared radiation layer faced to the side of the cover sheet. The object is to provide a stuffed toy which due to the far infrared heating characteristic produces a deeply penetrating warming of the user.

German Patent 2,238,014 issued to Mizoule sets forth an electronic remote-controlled toy such as a doll or tank which includes a radio receiver and small electric motor together with a battery power source. Control is exercised by the electrostatic field from a charged rod of synthetic plastic held in the hand of the operator. Thus, the toy or the like responds to the waving of the wand near the toy.

U.S. Pat. No. 413,058 issued to Hirsch sets forth an ELECTRICAL TOY in which a variety of thin flexible objects of various shape are individually supported upon a support base. The objects are formed of a material which readily becomes statically charged and undergoes movement once they are charged in response to another statically charged object moving closely thereby.

U.S. Pat. No. 4,553,748 issued to Allen, et al. sets forth an ELECTROSTATICALLY ENHANCED GAME for video arcade or the like including an electrostatic generator for generating a high voltage low current electrostatic charge. An electrode coupled to the generator provides an electrostatic charge to the player while control circuitry responsive to a control signal from the game actuate the electrostatic generator to provide the electrostatic charge to the player upon the occurrence of a predetermined game event.

U.S. Pat. No. 4,559,393 issued to Holubka sets forth a CROSSLINKABLE COMPOSITION COMPRISING AMINOEPOXY RESIN-III which comprises certain diene functional blocked dieneophile functional aminoepoxy resin which is self-crosslinkable at elevated cure temperature. The crosslinkable composition of matter is useful in coating and other applications especially solvent base primer coating compositions on cathodic electrocoating compositions.

U.S. Pat. No. 4,826,550 issued to Shimizu, et al. sets forth a PROCESS FOR PREPARING MOLDED PRODUCT OF THERMOCHROMIC POLYVINYL CHLORIDE characterized by incorporating a thermochromic particulate material into a vinyl chloride plastisol comprising a vinyl chloride resin, plasticizer, stabilizer, lubricant and filler and molding the resulting mixture.

While the foregoing described prior art has provided amusing and entertaining toys and has enjoyed various measures of commercial success, there remains nonetheless a need in the art for evermore interesting and improved dolls and toy figures having electrically interacting components and apparatus.

SUMMARY OF THE INVENTION

Accordingly, it is a general object of the present invention to provide an improved doll or toy figure. It is a more particular object of the present invention to provide an improved doll or toy figure having a novel and amusing interactive capability with electrical apparatus.

In accordance with the present invention, there is provided a doll and interactive electrical toy combination comprises: a doll having a body defining outer surfaces and an interior cavity; a plurality of electrically conductive areas supported upon at least a portion of the outer surfaces; a battery power source supported within the interior cavity; means for electrically coupling the battery power source to the conductive areas to provide an incomplete electrical circuit; and an electrical toy having a plurality of electrically conductive portions and an electrically powered device coupled to the electrically conductive portions in an incomplete electrical circuit, the doll being positionable to place the plurality of electrically conductive areas in contact with the plurality of electrically conductive portions to complete an electrical circuit between the battery power source and the electrically powered device thereby causing the electrically powered device to operate.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figures 1, 2:
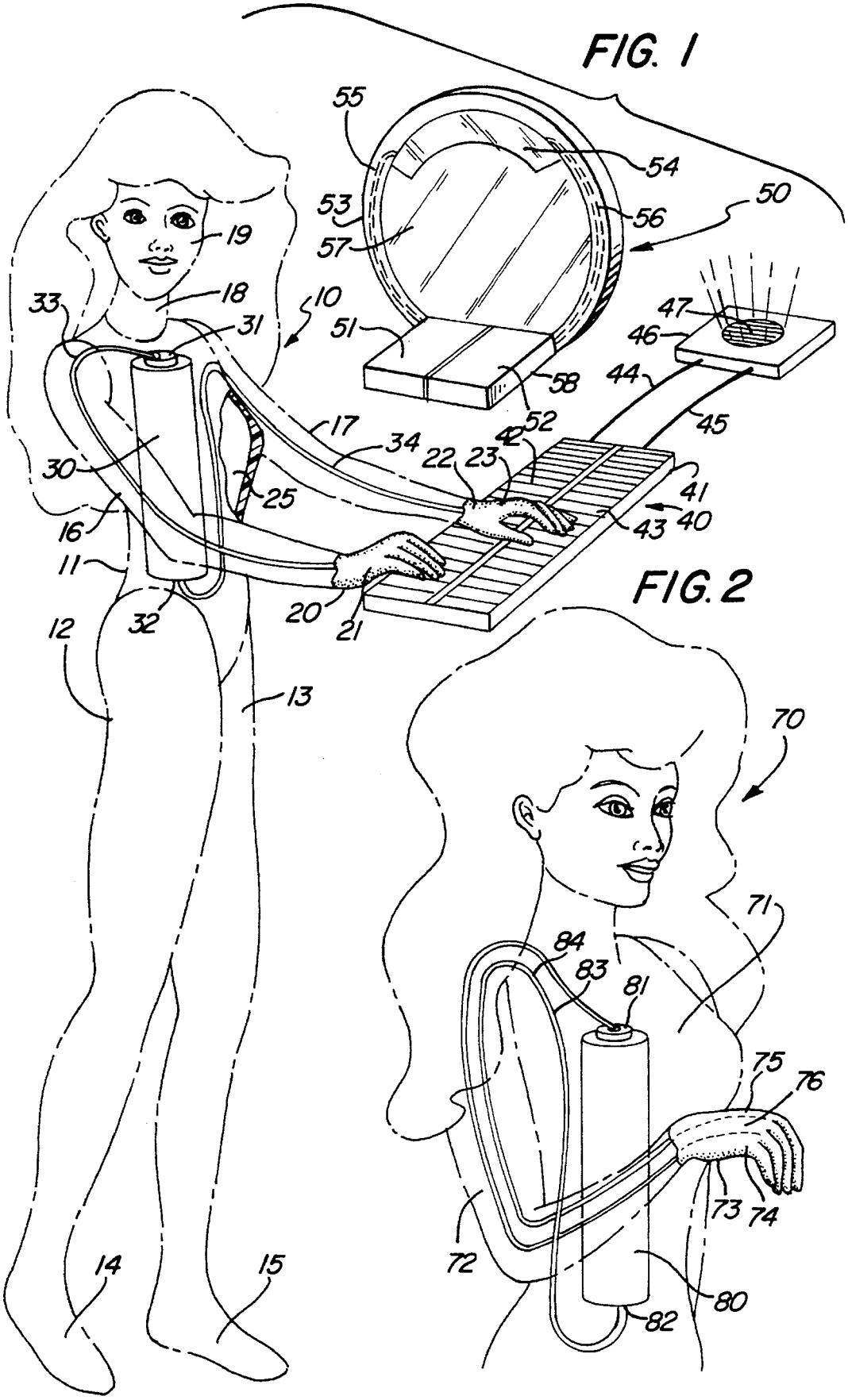
FIG. 1 sets forth a front perspective view of a doll constructed in accordance with the present invention in combination with an electronic sound apparatus.
FIG. 2 sets forth a partial perspective view of an alternate embodiment of the present invention doll.

FIG. 1 sets forth a front perspective view of a doll constructed in accordance with the present invention and generally referenced by numeral 10. For purposes of illustration, doll 10 is shown in dashed-line representation to facilitate the illustration of the internal battery source and conductive couplings utilized in the present invention. It will be recognized that doll 10 is preferably formed of an opaque material such as molded plastic or the like and that the battery source and conductive connections thereto are preferably supported within the interior of the hollow body of the doll. Thus, doll 10 includes a torso 11 defining an interior cavity 25 within which a battery power source 30 is supported using conventional fabrication techniques (not shown). Doll 10 further includes a pair of legs 12 and 13 having feet 14 and 15 extending therefrom. Doll 10 further includes a pair of arms 16 and 17 coupled to torso 11 in accordance with conventional fabrication techniques. Arms 16 and 17 support hands 20 and 22 respectively. In accordance with an important aspect of the present invention, hands 20 and 22 define outer conductive coating areas 21 and 23 respectively. A pair of electrical conductors 33 and 34 couple conductive coatings 21 and 23 respectively to positive terminal 31 and negative terminal 32 of battery power source 30. It should be noted while a conventional single battery is shown supported within interior cavity 25 of doll 10, virtually any battery source and battery size may be used consistent with the volume available within doll 10. Thus, battery source 30 is provided for illustrative purposes with the understanding that the present invention is not limited to any particular battery size or combination of batteries.

In accordance with the present invention, positive terminal 31 of battery source 30 is coupled to conductive coating 21 in a continuous electrical coupling. Correspondingly, negative terminal 32 of battery power source 30 is electrically coupled to conductive coating 23 of hand 22. Thus, the conductive coating surfaces of hands 21 and 22 have the same electrical potentials applied thereto as positive terminal 31 and negative terminal 32 of battery source 30.

In further accordance with the present invention, a plurality of interactive electrically powered toy apparatus are provided and exemplified in FIG. 1 as a musical toy 40 and a lighted mirror 50. It should be understood that musical toy 40 and lighted mirror 50 are merely intended to be illustrative examples of a virtually endless variety of electrically responsive apparatus which may be utilized in accordance with the present invention. Thus, in accordance with the present invention, it is anticipated that doll 10 may be moved about in a scene area within which a number of electrically responsive toy apparatus such as musical toy 40 and lighted mirror 50 are supported giving rise to the intended play pattern.

More specifically, musical toy 40 includes a simulated keyboard 41 having a pair of conductive areas 42 and 43 on the upper surface thereof. Musical toy 40 further includes a conventional sound circuit 46 having an output speaker 47. Sound circuit 46 may be constructed entirely in accordance with conventional fabrication techniques utilizing virtually any of the presently available music circuits which, in response to the application of battery power, produce output sounds or music. A pair of conductive wires 44 and 45 are coupled between conductive areas 42 and 43 respectively to form the power input connections for sound circuit 46.

In operation, doll 10 is positioned in the manner shown in FIG. 1 with hands 20 and 22 overlying conductive areas 42 and 43 respectively of simulated keyboard 41. As conductive coatings 21 and 23 are brought into contact with conductive areas 42 and 43 respectively, the electrical power within battery source 31 is coupled to sound circuit 46 of musical toy 40 via conductive wires 44 and 45. As a result, as the hands of doll 10 touch simulated keyboard 41, music is produced by sound circuit 46 giving rise to an amusing and entertaining play pattern.

In further accordance with the present invention, doll 10 may then separate from simulated keyboard 41 and move on to a second electrically responsive toy such as lighted mirror 50. Lighted mirror 50 may be constructed in accordance with conventional fabrication techniques providing a conventional mirror 57 supported by a frame 53 supported by a base 58. Base 58 in turn supports a pair of conductive pads 51 and 52 on the upper surfaces thereof. A conventional electric light 54 is supported upon the upper portion of frame 53 and is coupled to conductive pads 51 and 52 by conventional connecting wires 55 and 56 respectively.

Thus, in further accordance with the present invention as doll 10 moves into position in front of lighted mirror 50, hands 20 and 22 are positioned overlying conductive pads 51 and 52 respectively. Thereafter, as hands 20 and 22 are brought into contact with conductive pads 51 and 52 respectively, electrical power flows from battery source 30 through conductors 33 and 34 and conductive coatings 21 and 23 to conductive pads 51 and 52 respectively. This electrical power is further coupled by wires 55 and 56 to conventional light 54 completing an electrical circuit between battery source 30 and light 54 and energizing light 54 to produce light. Thus, as will be apparent to those skilled in the art, a virtually endless array of electrically responsive apparatus may be utilized in combination with the present invention doll.

Figures 3, 4:
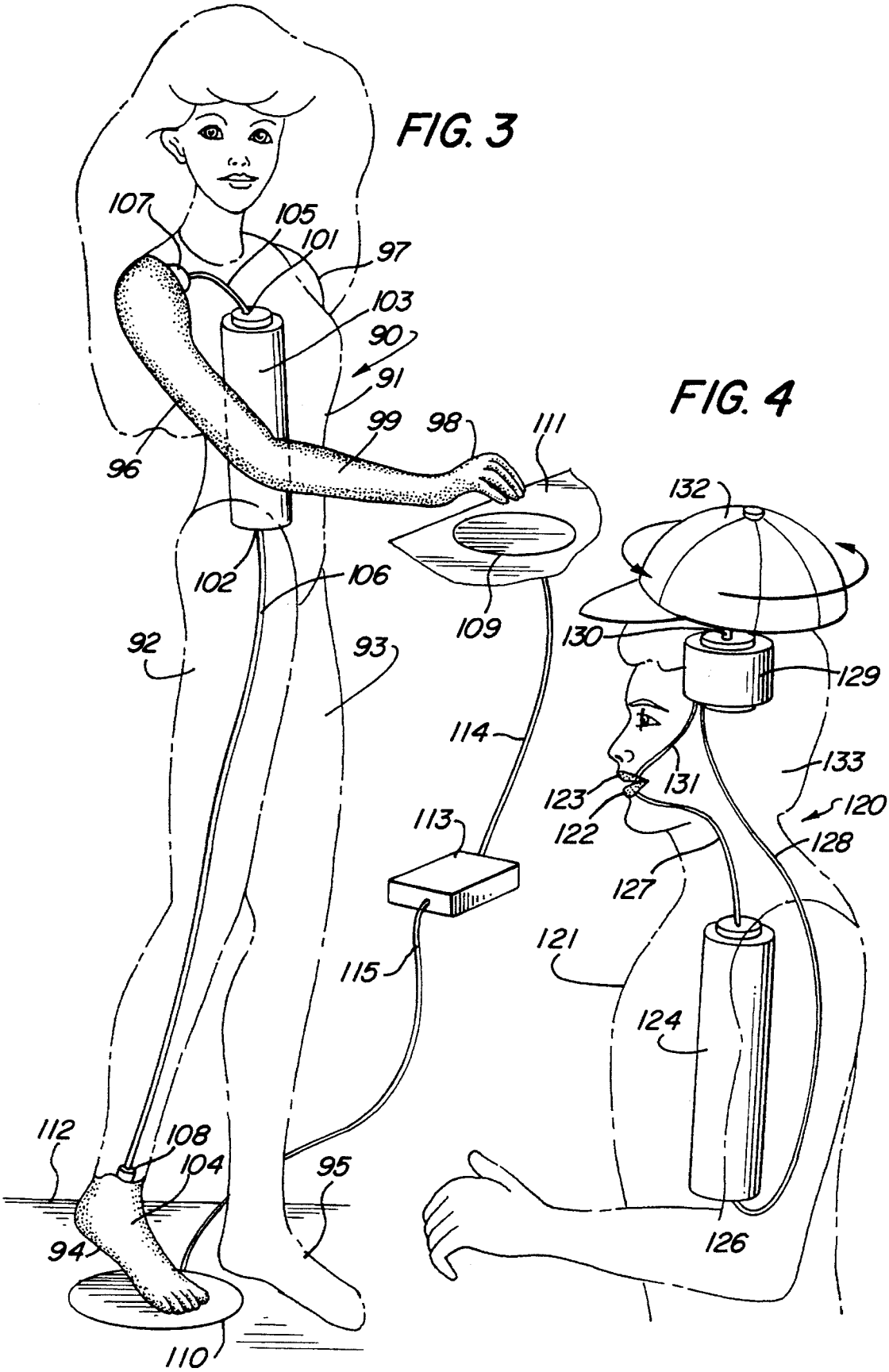
FIG. 3 sets forth a perspective view of a still further alternate embodiment of the present invention doll.
FIG. 4 sets forth a perspective view of a still further alternate embodiment of the present invention doll.
Figure 5:
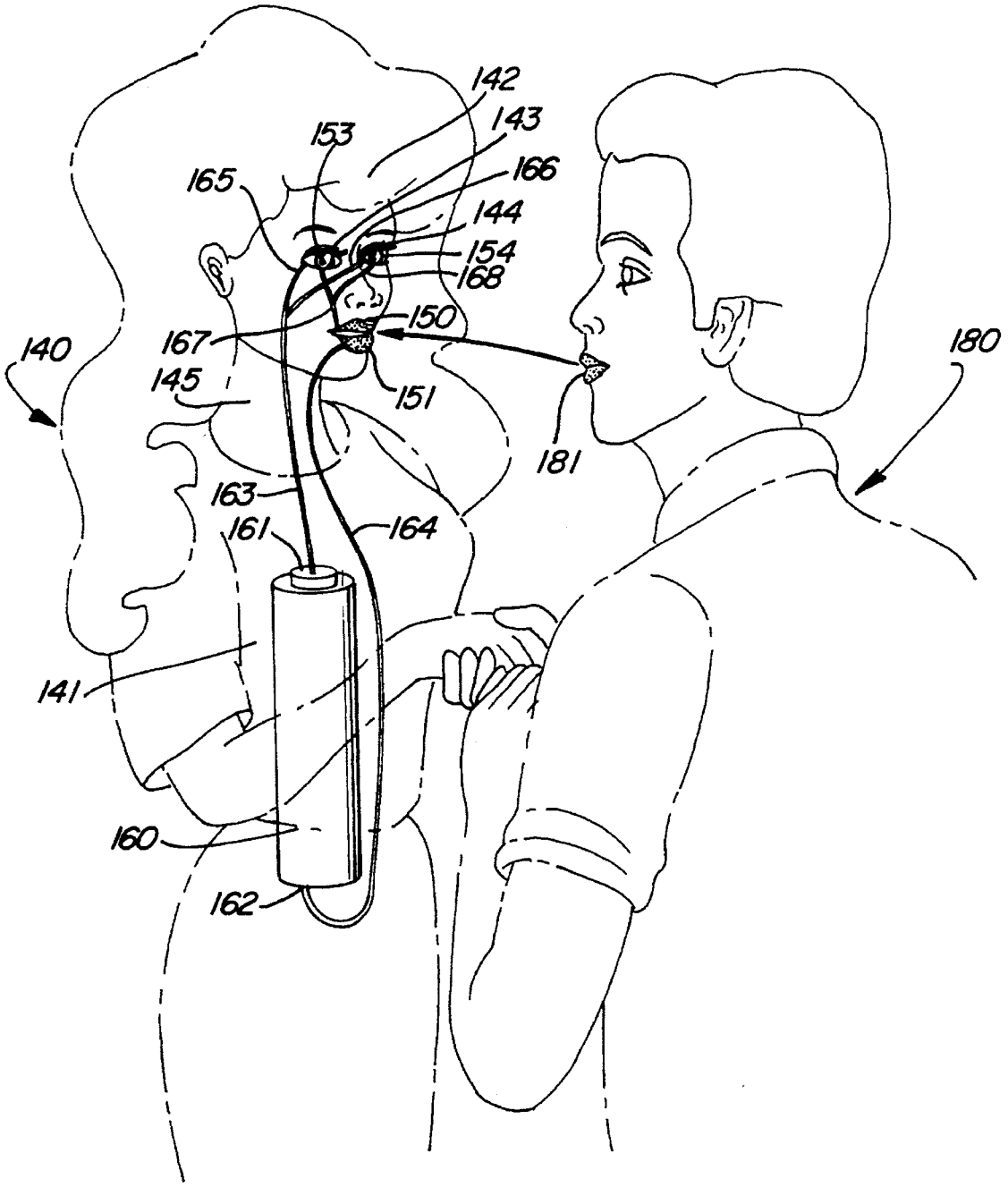
FIG. 5 sets forth a partial perspective view of a pair of interacting dolls constructed in accordance with the present invention.

Conductive coatings 21 and 22 may be fabricated using a variety of electrically conductive coatings or paints. Thus, virtually any of the presently available conductive inks, paints or coatings may be utilized to cover the desired extent of doll 10's outer surface. It will be apparent to those skilled in the art that while doll 10 utilizes relatively small coating areas upon hands 20 and 22 in the embodiment shown therein, virtually any surface area of doll 10 may be coated with the appropriate conductive coatings as needed in practicing the present invention. By way of example, FIG. 3 shows an embodiment of the present invention doll in which the entire arm is coated with a conductive material as well as a portion of the doll's foot. By way of further illustration, FIG. 2 shows an embodiment in which a pair of separate coating areas are formed on a common hand with appropriate electrical connections to the internal battery power source. FIGS. 4 and 5 set forth embodiments in which the conductive coating is limited to application to the doll's lip areas to provide an apparent "kiss" responsive toy. Thus, it will be apparent that virtually any area of the doll may be coated to virtually any extent in practicing the present invention.

FIG. 2 sets forth an alternate embodiment of the present invention doll generally referenced by numeral 70. Doll 70 is constructed in accordance with conventional fabrication techniques with the exception that a battery power source 80 is supported within torso 71 of doll 70. Doll 70 includes an arm 72 having a hand 73 supported thereby and secured to torso 71. A battery power source 80 having a positive terminal 81 and a negative terminal 82 is supported within torso 71 in accordance with conventional fabrication techniques. Hand 73 further includes a pair of conductive coating areas 74 and 75 separated by a nonconductive area 76. A pair of electrical conducting wires 83 and 84 couple positive terminal 81 and negative terminal 82 of battery source 80 respectively to conductive areas 74 and 75 of hand 73.

Doll 70 works in substantially the same manner as doll 10 set forth above in FIG. 1 with the difference being the provision of opposite polarity conductive areas 74 and 75 supported upon a common hand 73. The operation of doll 70 thus facilitates the activation of electrical apparatus in the manner described above in FIG. 1 with the difference being the physical accommodation of conductive areas 74 and 75 being positioned closely upon a common hand. Thus, doll 70 is able to provide operative power to electrical toy apparatus by simply touching a pair of conductive pads supported upon the electrical apparatus using a single hand. In other respects, however, the operation of doll 70 is substantially the same as doll 10.

FIG. 3 sets forth a still further alternate embodiment of the present invention doll generally referenced by numeral 90. Doll 90 includes a hollow torso 91 having a pair of legs 92 and 93 coupled thereto in accordance with conventional fabrication techniques. Legs 92 and 93 support feet 94 and 95 respectively. A conductive coating area 104 is formed upon foot 94. Doll 90 further includes a pair of arms 96 and 97 coupled to torso 91. Arm 96 supports a hand 98. Arm 96 and hand 98 include a conductive outer coating area 99. An electrical connector 107 is coupled to conductive coating area 99 and to a connecting wire 105. Similarly, a connector 108 is coupled to conductive coating area 104 and a connecting wire 106. A conventional battery power source 103 is supported within hollow torso 91 and includes a positive terminal 101 coupled to wire 105 and a negative terminal 102 coupled to wire 106. A conductive pad 110 is supported upon a play surface 112 while a second conductive pad 109 is supported upon a raised surface 111. Surfaces 112 and 111 may comprise surfaces of virtually any play area within which doll 90 is to be utilized. An electrical apparatus 113 is coupled to pads 109 and 110 by a pair of connecting wires 114 and 115 respectively. Electrical apparatus 113 includes conventional apparatus responsive to the application of electrical power such as sound or light producing apparatus.

Doll 90 is intended to be utilized in play environments which are suited to the provision of conductive coating upon both the doll's foot and hand allowing an additional facet of the present invention to be utilized. Thus battery source 103 of doll 90 is operatively coupled to conductive coating 99 of arm 96 and hand 98 through positive terminal 101 and to conductive coating 104 of foot 94 through negative terminal 102. As a result, doll 90 will energize electrical apparatus having conductive pads positioned to simultaneously contact foot 94 and hand 98 of doll 90. Conductive pad 110 within play surface 112 and conductive pad 109 upon raised surface 111 fulfill this requirement and, as a result, as doll 90 is positioned in the manner shown in FIG. 3 having foot 94 in contact with conductive pad 110, the pivotal motion of arm 96 downwardly places hand 98 into contact with conductive pad 109 energizing electrical apparatus 113. As a result as doll 90 moves about a properly constructed play scene in which a plurality of pads such as pads 110 and 109 are arrayed, a variety of electrical apparatus may be energized producing an interesting and amusing play pattern.

FIG. 4 sets forth a still further alternate embodiment of the present invention doll generally referenced by numeral 120. Doll 120 differs from the remaining embodiments of the present invention in that doll 120 includes an electrical responsive apparatus together with a battery power source. More specifically, doll 120 includes a hollow torso 121 within which a conventional battery power source 124 having a positive terminal 125 and a negative terminal 126 is supported. Doll 120 further includes a hollow head 133 within which an electric motor 129 having an output shaft 130 is supported. Shaft 130 extends upwardly through an aperture in head 133 and supports a rotatable hat 132. Doll 120 further includes a pair of lip areas 122 and 123 which in accordance with the present invention are coated with a conductive coating material and are electrically separate from each other. A connecting wire 127 couples positive terminal 125 of battery 124 to lip 122 while a conducting wire 131 couples lip 123 to one terminal of motor 129. The remaining terminal of motor 129 is coupled to negative terminal 128 of battery 124 by a conducting wire 128.

In operation, the separation of lips 122 and 123 maintains the electrical circuit coupling battery 124 to motor 129 in an open circuit condition. As such, in the absence of conductive coupling between lips 122 and 123, motor 129 remains inoperative. In the event a conducting material is placed in simultaneous contact with conductive lips 122 and 123, the circuit for motor 129 and battery 124 is complete and output shaft 130 rotates causing hat 132 to rotate accordingly. A number of play patterns may be utilized in combination with doll 120. For example, doll 120 may interact with doll 10 (seen in FIG. 1 by "kissing" either hands 20 or 22 such that conductive lips 122 and 123 are bridged by the conductive coating thereon. The bridging of lips 122 and 123 caused hat 132 to rotate as doll 120 kisses the hand of doll 10. It will be apparent however that a number of interactions with doll 10 or doll 90 may be utilized to produce the entertaining effect. It will be equally apparent that other conductive areas may be "kissed" by doll 120 to produce the desired effect as hat 132 rotates in response to the kiss.

FIG. 5 sets forth a partial perspective view of a still further alternate embodiment of the present invention comprising a doll generally referenced by numeral 140 and a cooperating doll generally referenced by numeral 180. Doll 140 includes a hollow torso 141 within which a battery power source 160 is supported. Battery power source 160 includes a positive terminal 161 and a negative terminal 162. Doll 140 further includes a neck 145 supporting a head 142. Head 142 supports a pair of eyes 143 and 144 having a pair of conventional electrical lamps 153 and 154 respectively supported therein. Hand 142 further includes a pair of conductive lip areas 150 and 151 forming electrically separate conductive surface areas. A connecting wire 163 couples positive terminal 161 of battery source 160 to lamps 153 and 154 using a pair of conductors 165 and 166 respectively. Lamps 153 and 154 are commonly coupled to lip 150 by a pair of connecting wires 167 and 168 respectively. Conductive lip 151 is coupled to negative terminal 162 of battery source 160 by a conductive wire 164. Thus, lamps 153 and 154 within eyes 143 and 144 respectively of doll 140 are operatively coupled to battery source 160 through lips 150 and 151. The electrical separation of lips 150 and 151 maintains an open circuit condition for lamps 153 and 154. Thus, lamps 153 and 154 remain inoperative so long as no conductive element bridges lips 150 and 151.

Doll 180 includes a conductive lip area 181 overlying the lip portion of doll 180. Accordingly, as doll 180 "kisses" doll 140 upon lips 150 and 151, conductive lip area 181 of doll 180 provides a conductive bridge between lips 150 and 151 completing the electrical power circuit for lamps 153 and 154. As a result as doll 180 "kisses" doll 140, lamps 153 and 154 are lighted and eyes 143 and 144 of doll 140 appear to sparkle in response to the "kiss". This provides an amusing an entertaining effect for the present invention doll. It will be apparent to those skilled in the art that doll 140 may be utilized with other apparatus apart from doll 180. Thus, virtually any electrical apparatus having conductive pads coupled thereto which are appropriately spaced to contact lips 150 and 151 of doll 140 will be energized by battery power source 160 and will respond to the kiss of doll 140 as eyes 143 and 144 sparkle simultaneously.

What has been shown is a novel and entertaining doll having conductive outer skin areas and an internal battery supply which provides an amusing and entertaining interactive activity with appropriately configured electrical apparatus. The doll may be fabricated in a number of different embodiments with the common aspect being the ability of the doll to energize or power otherwise passive electrical apparatus as the doll moves about the various electrical apparatus and touches or otherwise interacts therewith. The doll may be fabricated of a conventional molded plastic material or the like and may utilize conductive outer coatings formed of virtually any conductive coating, paint or ink to provide the inventive effect.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll and interactive electrical toy combination comprising:

a doll having a body defining a hand, a foot, outer surfaces and an interior cavity;

a plurality of electrically conductive areas supported upon at least a portion of said outer surfaces including a conductive area on said hand and said foot;

a battery power source supported within said interior cavity;

means for electrically coupling said battery power source to said conductive areas to provide an incomplete electrical circuit; and an electrical toy having a plurality of electrically conductive portions and an electrically powered device coupled to said electrically conductive portions in an incomplete electrical circuit, said doll being positionable to place said plurality of electrically conductive areas in contact with said plurality of electrically conductive portions to complete an electrical circuit between said battery power source and said electrically powered device thereby causing said electrically powered device to operate.

2. A doll and interactive toy combination as set forth in claim 1 wherein said doll body includes a hand and wherein said electrically conductive areas include a pair of electrically conductive areas each supported upon one of said hand.

3. A doll and interactive toy combination as set forth in claim 1 wherein said electrically powered device includes a sound producing circuit.

4. A doll and interactive toy combination as set forth in claim 1 wherein said electrically powered device includes an electric light.

5. A doll and interactive toy combination comprising:

a doll having a body defining outer surfaces and an interior cavity;

a plurality of electrically conductive areas supported upon at least a portion of said outer surfaces;

a battery power source supported within said interior cavity;

means for electrically coupling said battery power source to said conductive areas to provide an incomplete electrical circuit; and an electrical toy having a plurality of electrically conductive portions and an electrically powered device coupled to said electrically conductive portions in an incomplete electrical circuit, said doll being positionable to place said plurality of electrically conductive areas in contact with said plurality of electrically conductive portions to complete an electrical circuit between said battery power source and said electrically powered device thereby causing said electrically powered device to operate and said doll body including a pair of lips and wherein said electrically conductive areas include a pair of electrically conductive areas each supported upon one of said lips.

6. A doll and interactive toy combination comprising:

a doll having a body defining outer surfaces and an interior cavity;

a plurality of electrically conductive areas supported upon at least a portion of said outer surfaces;

a battery power source supported within said interior cavity;

means for electrically coupling said battery power source to said conductive areas to provide an incomplete electrical circuit;

an electrically powered device coupled to said conductive areas; and a cooperating toy having a conductive portion thereon, said cooperating toy and said doll being positionable to place said conductive portion in contact with said plurality of conductive areas to complete the electric circuit between said battery power source and said electrically powered device and said cooperating toy being a complementary doll having a pair of complementary lips and wherein said conductive portion covers said complementary lips.

7. A doll and interactive toy combination as set forth in claim 6 wherein said doll body includes a pair of eyes and wherein said electrically powered device includes a pair of lamps supported within said eyes.

* * * * *

US005466181B1

REEXAMINATION CERTIFICATE (3493rd)

United States Patent [19] [11] B1 5,466,181

Bennett et al. [45] Certificate Issued Apr. 14, 1998

[54] DOLL HAVING CONDUCTIVE OUTER SKIN AREAS AND INTERNAL BATTERY SUPPLY

[75] Inventors: Linda K. Bennett, Marina Del Rey; Joseph Feldman, Los Angeles, both of Calif.

[73] Assignee: Mattel, Inc., El Segundo, Calif.

Reexamination Request:
No. 90/004,409, Oct. 7, 1996

Reexamination Certificate for:

| | |
|---|---|
| Patent No.: | **5,466,181** |
| Issued: | **Nov. 14, 1995** |
| Appl. No.: | **251,156** |
| Filed: | **May 31, 1994** |

[51] Int. Cl.[6] ..... A63H 3/28; A63H 33/26
[52] U.S. Cl. ..... 446/297; 446/485
[58] Field of Search ..... 446/484, 485, 446/438, 439, 385, 352, 353, 358, 268, 91, 26, 28

[56] References Cited

U.S. PATENT DOCUMENTS

| | | | |
|---|---|---|---|
| 844,577 | 2/1907 | Borchardt | 446/484 X |
| 2,794,298 | 6/1957 | Mason | 446/485 X |
| 3,808,418 | 4/1974 | Conard et al. | 446/485 X |
| 4,157,630 | 6/1979 | Sawai | 446/484 X |
| 4,282,681 | 8/1981 | McCaslin | 446/484 |
| 4,556,393 | 12/1985 | Bolli | 446/484 X |
| 5,455,749 | 10/1995 | Ferber | 446/91 X |
| 5,482,277 | 1/1996 | Young | 446/485 X |

*Primary Examiner*—Robert A. Hafer

[57] ABSTRACT

A doll includes a hollow torso within which a battery power source is supported. The doll further includes a pair of outer surface areas supporting coating or deposits of conductive material. Electrical connection is provided between the conductive outer surface areas and the internal battery power source. A plurality of electrical toy apparatus such as a music or sound producing device or a lighted mirror are provided with conductive pads and electrical connection thereto. In the anticipated play pattern, the doll contacts the electrical apparatus conductive pads using the conductive outer areas of the doll's outer surface to provide electrical connection between the internal battery power supply of the doll and the electrical toy apparatus. Thereafter and so long as the contact is maintained, the battery source within the doll powers the electrical apparatus to provide the desired effect.

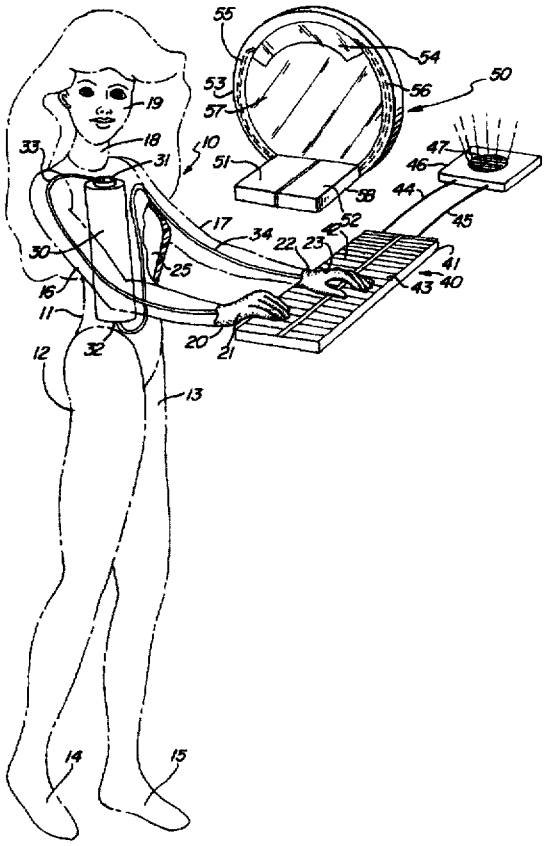

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–7 are cancelled.

* * * * *